US009254664B2

(12) United States Patent
Matsumoto et al.

(10) Patent No.: US 9,254,664 B2
(45) Date of Patent: Feb. 9, 2016

(54) DROPLET EJECTING APPARATUS

(71) Applicant: SEIKO EPSON CORPORATION, Tokyo (JP)

(72) Inventors: Hitoshi Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/586,610

(22) Filed: Dec. 30, 2014

(65) Prior Publication Data

US 2015/0191016 A1 Jul. 9, 2015

(30) Foreign Application Priority Data

Jan. 7, 2014 (JP) ..... 2014-000786
Jan. 14, 2014 (JP) ..... 2014-003968

(51) Int. Cl.
*B41J 2/165* (2006.01)

(52) U.S. Cl.
CPC ..... *B41J 2/16538* (2013.01); *B41J 2/16508* (2013.01)

(58) Field of Classification Search
CPC ..... B41J 2/16505; B41J 2/16523; B41J 2/16526; B41J 2/16552; B41J 2002/14419; B41J 2002/16573
See application file for complete search history.

(56) References Cited

U.S. PATENT DOCUMENTS 8,734,037 B2 * 5/2014 Kawaguchi ..... B41J 11/008 347/104
2013/0241992 A1 9/2013 Shimizu et al.

FOREIGN PATENT DOCUMENTS

| | | |
|---|---|---|
| JP | 2001-018408 | 1/2001 |
| JP | 2012-171320 | 9/2012 |
| JP | 2012-206516 | 10/2012 |
| JP | 2013-176935 | 9/2013 |
| JP | 2013-216095 | 10/2013 |

* cited by examiner

*Primary Examiner* — Lamson Nguyen
(74) *Attorney, Agent, or Firm* — Workman Nydegger

(57) ABSTRACT

A droplet ejecting apparatus includes a droplet ejecting unit provided with ejecting ports capable of ejecting a solution onto a medium as droplets; a cap portion which performs capping in which a region to which the ejecting ports are open is set to a closed space; a gas supply portion capable of supplying a humidified gas to the closed space; and a liquid supply portion capable of supplying a liquid for humidifying the closed space.

10 Claims, 3 Drawing Sheets

DROPLET EJECTING APPARATUS

BACKGROUND

1. Technical Field

The present invention relates to a droplet ejecting apparatus such as a printer, for example.

2. Related Art

In the related art, as an example of a droplet ejecting apparatus, there is an ink jet printer provided with an ink jet head which ejects ink droplets from ejecting ports toward paper or the like, a cap which performs capping to isolate a space to which ejecting ports are open from an external space, and a humidified air supply mechanism which supplies humidified air to the space that is isolated by the cap (for example, refer to JP-A-2012-171320).

In the printer described above, when the ink droplets are ejected from the ejecting ports, it is possible to quickly raise the humidity in the proximity of the ejecting ports by supplying the humidified air to the space that is isolated from the external space by the cap. However, for example, when the printer is not used for a long time in a state in which the power source is turned off, there is a problem in which it is difficult to supply the humidified air and the humidity in the proximity of the ejecting ports is reduced.

SUMMARY

An advantage of some aspects of the invention is to provide a droplet ejecting apparatus which is capable of suppressing a reduction in the humidity in the proximity of the ejecting ports of the droplets.

Hereinafter, means of the invention and operation effects thereof will be described.

A droplet ejecting apparatus that solves the problem described above includes a droplet ejecting unit provided with ejecting ports capable of ejecting a solution onto a medium as droplets; a cap portion which performs capping in which a region to which the ejecting ports are open is set to a closed space; a gas supply portion capable of supplying a humidified gas to the closed space; and a liquid supply portion capable of supplying a liquid for humidifying the closed space.

According to this configuration, when the gas supply portion supplies a humidified gas to the closed space, it is possible to quickly raise the humidity in the proximity of the ejecting ports of the capped droplet ejecting unit. When the liquid supply portion supplies the liquid for humidifying the closed space in a capped state, it is possible to maintain the humidity in the closed space at a high state for a longer time due to the liquid gradually evaporating in the closed space. Therefore, it is possible to suppress a reduction in the humidity in the proximity of the ejecting ports of the droplets.

In the droplet ejecting apparatus, when an elapsed time from the cap portion being removed is longer than a threshold, a next capping may be performed in a state in which the closed space contains the liquid supplied by the liquid supply portion.

In this case, when the elapsed time from the cap portion being removed is longer than the threshold, it is possible to increase the amount of the liquid component present within the closed space and to perform the humidification at a higher humidity by performing the next capping in a state in which the closed space contains the liquid supplied from the liquid supply portion.

In the droplet ejecting apparatus, when an elapsed time from the cap portion being removed is less than or equal to a threshold, a next capping may be performed in a state in which the closed space contains a humidified gas supplied by the gas supply portion.

In this case, when the elapsed time from the cap portion being removed is equal to or less than the threshold, it is possible to reduce the amount of the liquid that is consumed for the humidification by performing the next capping in a state in which the closed space contains the gas supplied by the gas supply portion.

The droplet ejecting apparatus may further include a fluid pooling portion provided such that a liquid pooling portion capable of pooling a liquid and a gas pooling portion capable of pooling a gas communicate with each other, in which the liquid supply portion supplies a liquid pooled in the liquid pooling portion to the cap portion, and the gas supply portion supplies a gas pooled in the gas pooling portion to the closed space.

In this case, since the liquid pooling portion communicates with the gas pooling portion, it is possible to humidify the gas pooled in the gas pooling portion using the liquid pooled in the liquid pooling portion. Therefore, since it is not necessary to provide a mechanism for generating humidified air separately from the fluid pooling portion provided with the liquid pooling portion, it is possible to simplify the configuration of the apparatus. Since the liquid supply portion supplies the liquid pooled in the liquid pooling portion to the cap portion, it is possible to maintain the humidity in the proximity of the ejecting ports in the capped state while suppressing the adhesion of droplets to the droplet ejecting unit. Since the gas supply portion supplies the gas pooled in the gas pooling portion to the closed space, it is possible to suppress the leaking of the humidified gas and efficiently maintain the humidity of the closed space.

In the droplet ejecting apparatus, the gas supply portion may be provided with a gas supply port out of which a gas is capable of flowing, the liquid supply portion may be provided with a liquid supply port out of which a liquid is capable of flowing, and the gas supply port and the liquid supply port may be open toward an outside of a region in which the medium is disposed.

In this case, since the gas supply port and the liquid supply port are open toward to outside of the region in which the medium is disposed, even when the liquid leaks from the gas supply port or the liquid supply port, it is possible to suppress the adhesion of the leaked liquid to the medium.

The droplet ejecting apparatus may further include a wiper capable of wiping an opening surface in which the ejecting ports of the droplet ejecting unit are opened, in which, when performing capping when a power source is turned off, after turning on the power source, the wiper wipes the opening surface before the droplet ejecting unit ejects droplets onto the medium.

When the power source is turned off in a state in which the inside of the closed space is humidified, there is a case in which, when the temperature drops, condensation forms on the opening surface. When the liquid that condenses in this manner comes into contact with the droplets ejected toward the medium from the ejecting ports, there is a concern that the flight direction of the ejected droplets will be shifted. To address this point, in this case, after turning on the power source, since the wiper wipes the opening surface before the droplet ejecting unit ejects the droplets onto the medium, it is possible to remove the condensed liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of an embodiment of the droplet ejecting apparatus with reference to the drawings.

The droplet ejecting apparatus is, for example, an ink jet printer that performs printing by ejecting ink onto a medium such as paper. The ink is an example of a solution containing a solvent component and a solute component.

First Embodiment

Figure 1:
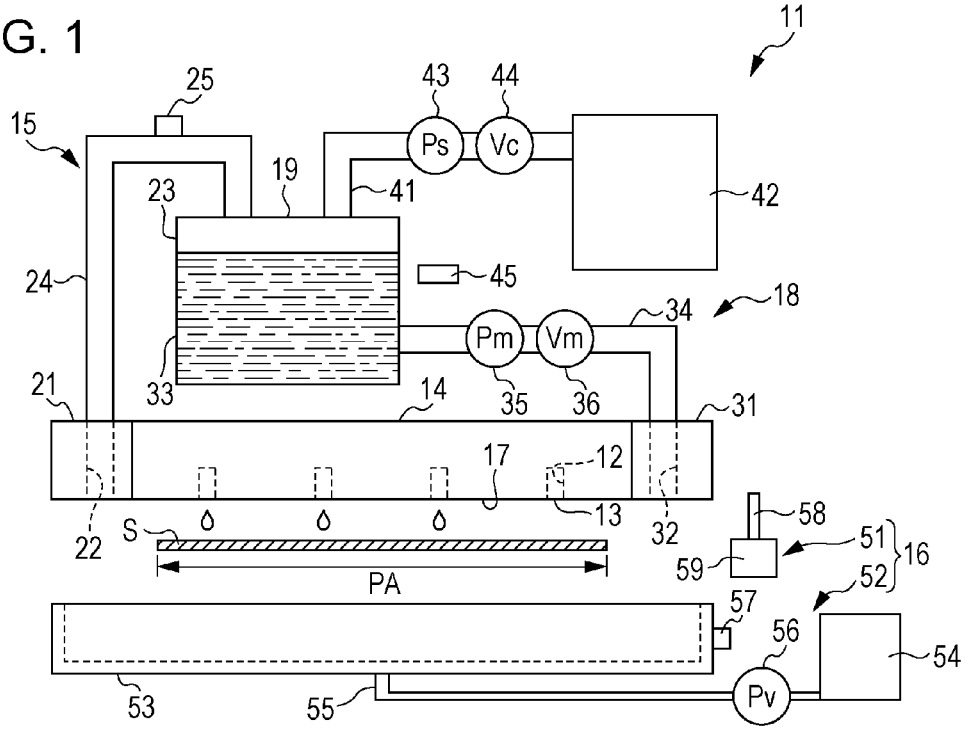
FIG. 1 is a schematic diagram illustrating a configuration of a droplet ejecting apparatus of a first embodiment.
Figure 4:
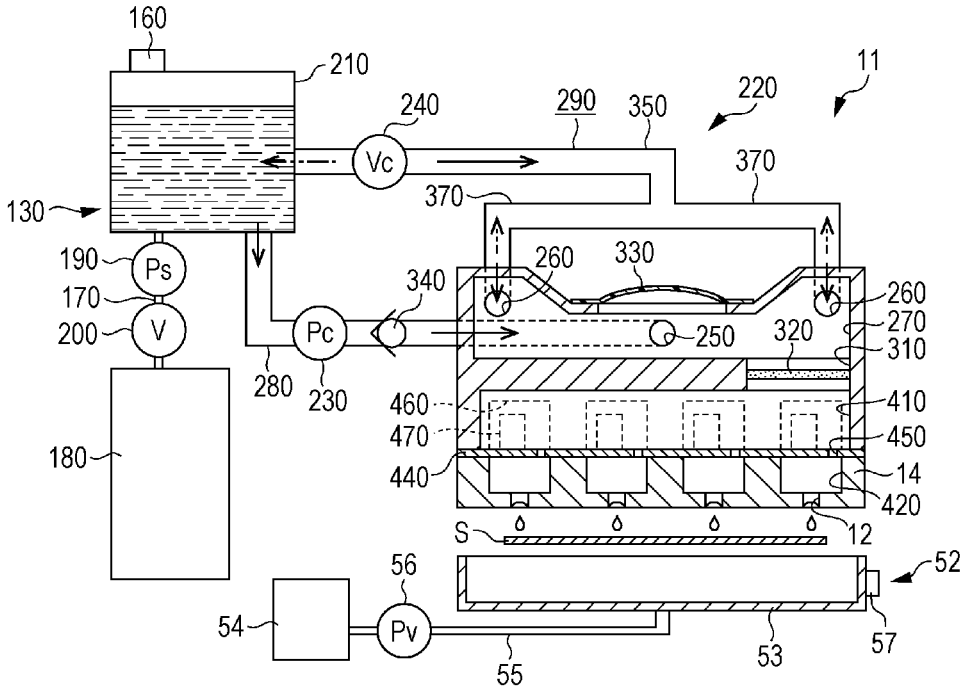
FIG. 4 is a schematic diagram illustrating a configuration of a solution supply mechanism that is provided in the droplet ejecting apparatus of the first embodiment.
Figure 5:
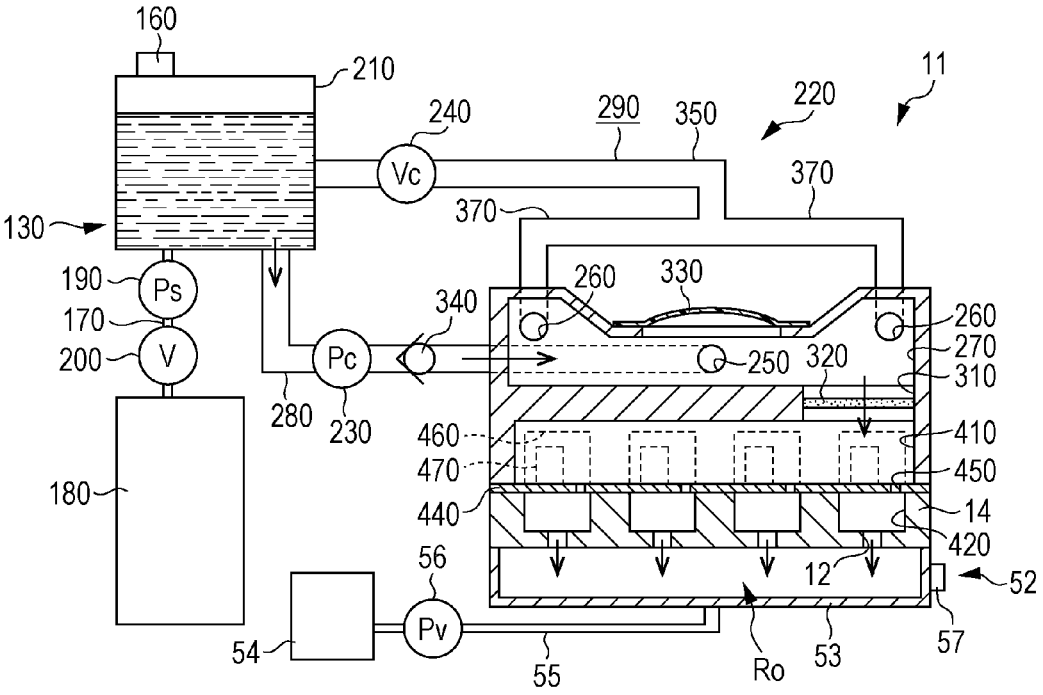
FIG. 5 is a schematic diagram illustrating operations of the solution supply mechanism that is provided in the droplet ejecting apparatus of the first embodiment.

As illustrated in FIG. 1, a droplet ejecting apparatus 11 of the present embodiment is provided with a droplet ejecting unit 14, a humidifying mechanism 15, a maintenance mechanism 16, and a solution supply mechanism 130 (refer to FIGS. 4 and 5). The droplet ejecting unit 14 is provided with ejecting ports 13 of nozzles 12 that are capable of ejecting a solution as droplets, the maintenance mechanism 16 performs maintenance on the droplet ejecting unit 14, and the solution supply mechanism 130 supplies a solution to the droplet ejecting unit 14.

Figure 2:
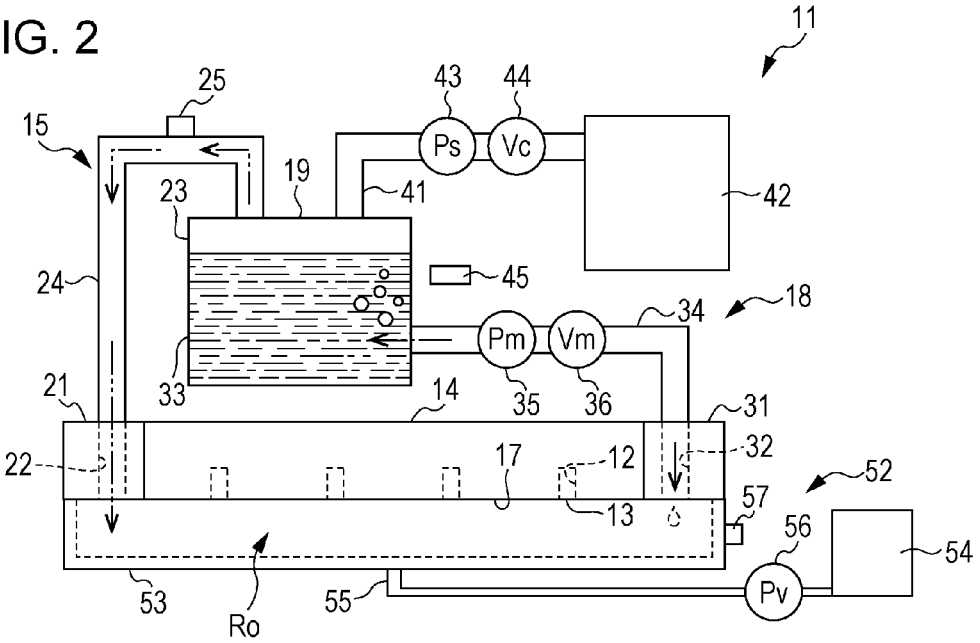
FIG. 2 is a schematic diagram illustrating operations of the droplet ejecting apparatus of the first embodiment.

Note that, in FIGS. 1 and 2, depiction of the solution supply mechanism 130 is omitted in order to clarify the configuration of the humidifying mechanism 15. In the present embodiment, description is given of a configuration in which printing is performed by the droplet ejecting unit 14 ejecting droplets onto a medium S that is disposed in a printing region PA which extends in a direction that is perpendicular to a paper surface.

For example, a plurality of the ejecting ports 13 are open in a opening surface 17 formed of the lower surface of the droplet ejecting unit 14. The plurality of nozzles 12 provided in the droplet ejecting unit 14 may, for example, eject different types of solution such as different colors of ink, and the plurality of nozzles 12 which eject the same type of solution may be provided in the droplet ejecting unit 14.

FIG. 1 illustrates a state in which the plurality of nozzles 12 which eject the same type of solution are formed in the opening surface 17 of the droplet ejecting unit 14 that opposes the printing region PA on which the medium S is disposed are lined up in a direction (a nozzle row direction, which is the left-right direction in FIG. 1) that intersects the transport direction (a direction which is perpendicular to the paper surface in FIG. 1) to form a nozzle row.

Next, detailed description will be given of the configuration of the humidifying mechanism 15.

The humidifying mechanism 15 is provided with a gas supply portion 21, a liquid supply portion 31, and a supply mechanism 18. The gas supply portion 21 and the liquid supply portion 31 are disposed to line up with the droplet ejecting unit 14, and the supply mechanism 18 is connected to the gas supply portion 21 and the liquid supply portion 31. The gas supply portion 21 and the liquid supply portion 31 can be disposed such as to be adjacent to each side of the droplet ejecting unit 14 in the nozzle row direction.

The gas supply portion 21 is a portion provided with a gas supply port 22 out of which a gas is capable of flowing, and the liquid supply portion 31 is a portion provided with a liquid supply port 32 out of which a liquid is capable of flowing. The gas supply portion 21 and the liquid supply portion 31 can be provided as separate bodies from the droplet ejecting unit 14, and can be configured so as to adopt a structure which is integrated with the droplet ejecting unit 14, and such that the ejecting ports 13, the gas supply port 22, and the liquid supply port 32 are opened in the same member. Note that, it is preferable that the gas supply port 22 and the liquid supply port 32 be open toward the outside of the printing region PA in which the medium S may be disposed.

The supply mechanism 18 is provided with a fluid pooling portion 19, a gas supply flow path 24, and a liquid supply flow path 34. The fluid pooling portion 19 includes a liquid pooling portion 33 capable of pooling a liquid and a gas pooling portion 23 capable of pooling a gas, the gas supply flow path 24 connects the gas pooling portion 23 to the gas supply portion 21, and the liquid supply flow path 34 connects the liquid pooling portion 33 to the liquid supply portion 31. In the fluid pooling portion 19, the liquid pooling portion 33 that is positioned on the lower side in the vertical direction and the gas pooling portion 23 which is positioned on the upper side in the vertical direction communicate with each other.

It is preferable that the liquid pooled in the liquid pooling portion 33 be a liquid containing the solvent component of the solution. For example, when the main component of the solvent is water, a liquid with water as the main component or water is pooled in the liquid pooling portion 33. In the present embodiment, a liquid which contains the solvent component of the solution and is pooled in the liquid pooling portion 33 is referred to as the maintenance liquid.

A gas which is formed when the liquid pooled in the liquid pooling portion 33 evaporates is pooled in the gas pooling portion 23. In the present embodiment, the gas pooled in the gas pooling portion 23 is referred to as a humidified gas. In other words, the humidified gas in the present embodiment is air containing a vaporized solvent component.

The supply mechanism 18 is further provided with a liquid storage portion 42, a supply pump 43, a valve 44, and a detection unit 45. The liquid storage portion 42 is connected to the fluid pooling portion 19 via a connecting flow path 41, the supply pump 43 is provided in the connecting flow path 41, the valve 44 is disposed between the supply pump 43 and the liquid storage portion 42 in the connecting flow path 41, and the detection unit 45 detects a liquid surface position in the fluid pooling portion 19. In this case, when the detection unit 45 detects that the liquid surface position in the fluid pooling portion 19 is lower than a predetermined position, it is possible to supply the maintenance liquid to the fluid pooling portion 19 by driving the supply pump 43 in a state in which the valve 44 is open.

Note that, a configuration may be adopted in which the fluid pooling portion 19 is directly refilled with the maintenance liquid, or the maintenance liquid is refilled by exchanging a cartridge-shaped fluid pooling portion 19 without providing the connecting flow path 41, the liquid storage portion 42, the supply pump 43, the valve 44, and the detection unit 45.

The liquid supply flow path 34 is provided with a pump 35, and an open-close valve 36. The pump 35 is for supplying the maintenance liquid pooled in the liquid pooling portion 33 to the liquid supply portion 31, and the open-close valve 36 is for performing the opening and closing of the flow path between the pump 35 and the liquid pooling portion 33. It is preferable that the pump 35 be configured to cause the fluid within the liquid supply flow path 34 to flow from the fluid pooling portion 19 side to the liquid supply portion 31 side when driven in a first direction, and to conversely cause the fluid within the liquid supply flow path 34 to flow from the liquid supply portion 31 side to the fluid pooling portion 19 side when driven in a second direction which is the opposite direction of the first direction.

An atmosphere-open valve 25 is provided in the gas supply flow path 24. When the atmosphere-open valve 25 is in the atmosphere-open state, as indicated by the double-dot-dash line arrows in FIG. 2, the humidified gas pooled in the gas pooling portion 23 is exhausted from the gas supply port 22 provided in the gas supply portion 21. Meanwhile, when the atmosphere-open valve 25 is in the open-valve state, since the humidified gas pooled in the gas pooling portion 23 is released into the atmosphere, the humidified gas is not exhausted from the gas supply port 22.

Next, detailed description will be given of the configuration of the maintenance mechanism 16.

The maintenance mechanism 16 is provided with a wiping mechanism 51 and a capping mechanism 52. The wiping mechanism 51 is for wiping the opening surface 17 in which the ejecting ports 13 are opened in the droplet ejecting unit 14, and the capping mechanism 52 is for suppressing clogging of the ejecting ports 13.

The capping mechanism 52 is provided with a cap portion 53, a waste liquid storage portion 54, a waste liquid flow path 55, a pressure reducing mechanism 56, and an atmosphere-open valve 57. The cap portion 53 is capable of moving relative to the droplet ejecting unit 14, the waste liquid flow path 55 connects the cap portion 53 to the waste liquid storage portion 54, the pressure reducing mechanism 56 is provided in the waste liquid flow path 55, and the atmosphere-open valve 57 is attached to the cap portion 53.

As illustrated in FIG. 2, the cap portion 53 moves in a direction approaching the droplet ejecting unit 14 and performs capping in which the region (the space) to which the ejecting ports 13, the gas supply port 22, and the liquid supply port 32 are open is set to a closed space Ro. The cap portion 53 is not limited to having the shape of a box including a bottom and an opening portion as illustrated in FIG. 2. For example, a ring-shaped elastic member surrounding the region to which the ejecting ports 13 are open may be disposed on the droplet ejecting unit 14 and the cap portion 53 may be a plate-shaped member that forms the closed space Ro by making contact with the elastic member.

When the droplet ejecting unit 14 is capped, the closed space Ro is open to the atmosphere when the atmosphere-open valve 57 is in the open-valve state, and conversely, the closed space Ro is in a substantially sealed state when the atmosphere-open valve 57 is in the closed-valve state. Therefore, after the droplet ejecting unit 14 is capped, when the atmosphere-open valves 25 and 57, and the open-close valve 36 are set to the closed-valve state and the pressure reducing mechanism 56 is driven, the pressure within the closed space Ro is reduced and a negative pressure is generated, and suction cleaning is performed. In the suction cleaning, bubbles and the like that enter the droplet ejecting unit 14 through the ejecting ports 13 are discharged together with the solution. The solution (the waste liquid) which is discharged from the ejecting ports 13 into the cap portion 53 by the suction cleaning enters the waste liquid storage portion 54 through the waste liquid flow path 55 and is stored in the waste liquid storage portion 54.

As illustrated in FIG. 1, the wiping mechanism 51 is provided with a wiper 58 and a movable body 59. The wiper 58 is capable of wiping the opening surface 17 of the droplet ejecting unit 14, and the movable body 59 holds the wiper 58 and moves. The wiper 58 performs the wiping in which the solution or the like adhered to the opening surface 17 is wiped by moving together with the movement of the movable body 59 while in contact with the opening surface 17 after the execution of the suction cleaning or the like, for example. The liquid or the maintenance liquid adhered to the gas supply port 22 and the liquid supply port 32 may be wiped by the wiper 58.

Next, description will be given of the operations of the droplet ejecting apparatus 11 of the present embodiment, and the operations of the humidifying mechanism 15.

When the droplet ejecting unit 14 does not eject droplets from the ejecting ports 13, the drying of the ejecting ports 13 is suppressed by performing the capping using the cap portion 53 as illustrated in FIG. 2. For example, when the printing ends, the cap portion 53 moves in a direction approaching the droplet ejecting unit 14 to surround and form the closed space Ro to which the ejecting ports 13 or the like are open, and the atmosphere-open valve 57 is subsequently set to the valve-closed state. When performing the printing again, after setting the atmosphere-open valve 57 to the open-valve state, the cap portion 53 moves in a direction separating from the droplet ejecting unit 14, and the cap portion 53 is removed.

Note that, when the droplet ejecting unit 14 performs printing as illustrated in FIG. 1, since droplets are ejected intermittently from the ejecting ports 13 according to the print data, when the printing takes a long time, there is a concern that, in particular, the nozzles 12 that have a low droplet ejection frequency will become dry, and the ejecting ports 13 will become blocked.

Therefore, when the elapsed time from the cap portion 53 being removed is longer than a predetermined threshold, it is preferable that the liquid supply portion 31 supply the maintenance liquid pooled in the liquid pooling portion 33 to the cap portion 53, and that the next capping be performed in a state in which the closed space Ro contains the maintenance liquid supplied from the liquid supply portion 31. This is because, if such a configuration is adopted, it is possible to humidify the closed space Ro at a higher humidity by increasing the amount of solvent component present in the closed space Ro, and it is possible to maintain the high humidity for a longer time than in the case in which humidified air is supplied.

Note that, by driving the pump 35 in the first direction in a state in which the open-close valve 36 is open, as indicated by the solid-line arrow in FIG. 2, the maintenance liquid flows from the liquid pooling portion 33 toward the liquid supply portion 31, and is discharged from the liquid supply port 32 toward the cap portion 53. In this case, the capping may be performed after supplying the maintenance liquid to the cap portion 53 in a state in which the cap portion 53 is moved to a position on the side to which the liquid supply port 32 is open (for example, the bottom of the droplet ejecting unit 14 in the vertical direction) and is disposed, and the maintenance liquid may be supplied to the cap portion 53 after performing the capping.

When the maintenance liquid is introduced to the cap portion 53 and the capping is performed, a configuration may be adopted in which, when the cap portion 53 is removed, the maintenance liquid remaining in the cap portion 53 is collected in the waste liquid storage portion 54 by driving the pressure reducing mechanism 56.

Meanwhile, when the elapsed time from the cap portion 53 being removed is equal to or less than the threshold described above, it is preferable to perform the next capping in a state in which the closed space Ro contains the humidified gas supplied by the gas supply portion 21. In this case, after the atmosphere-open valve 57 is set to the closed-valve state by performing the capping, in addition to setting the atmosphere-open valve 25 to the closed-valve state, the open-close valve 36 is set to the open-valve state and the pump 35 is driven in the second direction. Thus, the humidified gas within the gas pooling portion 23 flows into the closed space Ro through the gas supply flow path 24, and the gas within the closed space Ro flows out toward the fluid pooling portion 19 through the liquid supply flow path 34. As a result, the gas circulates between the fluid pooling portion 19 and the closed space Ro. At this time, the liquid supply flow path 34 functions as a return flow path for allowing the gas within the closed space Ro to return to the fluid pooling portion 19.

Here, since the liquid supply flow path 34 is connected to the liquid pooling portion 33 of the fluid pooling portion 19, the gas that flows out from the closed space Ro is humidified by making contact with the maintenance liquid within the liquid pooling portion 33, subsequently leaves the maintenance liquid through the liquid surface, and enters the gas pooling portion 23.

In this manner, by providing the liquid pooling portion 33 and the gas pooling portion 23 within the single fluid pooling portion 19, in comparison with a case in which two separate pooling portions are provided, it is possible to simplify the configuration. Additionally, it is possible to humidify the gas using the maintenance liquid within the liquid pooling portion 33 in the process of causing the gas to circulate between the closed space Ro and the fluid pooling portion 19. By causing the gas to circulate between the fluid pooling portion 19 and the closed space Ro, it is possible to humidify the closed space Ro more actively than in a case in which the gas pooling portion 23 and the closed space Ro are simply communicated through the gas supply flow path 24.

However, in a case in which, when performing the capping when the power source is turned off in a state in which humidity in the closed space Ro is maintained by the humidified gas or the maintenance liquid, the temperature of the periphery of the cap portion 53 is reduced, there is a concern that condensation may occur on the opening surface 17. When the droplets ejected from the ejecting ports 13 make contact with the condensed liquid, there is also a concern that the flight direction of the droplets will be shifted or the like and the print quality will decrease.

Therefore, when the power source is turned on and the cap portion 53 is removed, it is preferable to remove the condensed liquid by wiping the opening surface 17 using the wiper 58 before the droplet ejecting unit 14 ejects the droplets onto the medium S. If such a configuration is adopted, it is possible to suppress the shifting of the flight direction of the droplets.

Note that, if the gas supply port 22 and the liquid supply port 32 are configured to be open toward the outside of the printing region PA of the medium S, even when the liquid that condenses within the gas supply flow path 24, the maintenance liquid that leaks from liquid supply flow path 34, or the like drips, the medium S is not dirtied.

There is also a case in which mist of the solution generated together with the ejecting of the droplets, paper dust arising from the paper, which is the medium S, or the like adhere to the opening surface 17 and cause ejection problems. Therefore, it is preferable that the wiping of the opening surface 17 performed by the wiper 58 be performed after printing is performed for a predetermined time, for example. Note that, when the printing time is long, there is a case in which the solvent component of the solution adhered to the opening surface 17 evaporates and the adhered paper dust, solute component, and the like solidify.

Therefore, a configuration may be adopted in which, in a case such as when performing wiping after the printing, the maintenance liquid discharged from the liquid supply portion 31 is adhered to the wiper 58, and the wiping is performed while dissolving the solute component using the adhered liquid.

Figure 3:
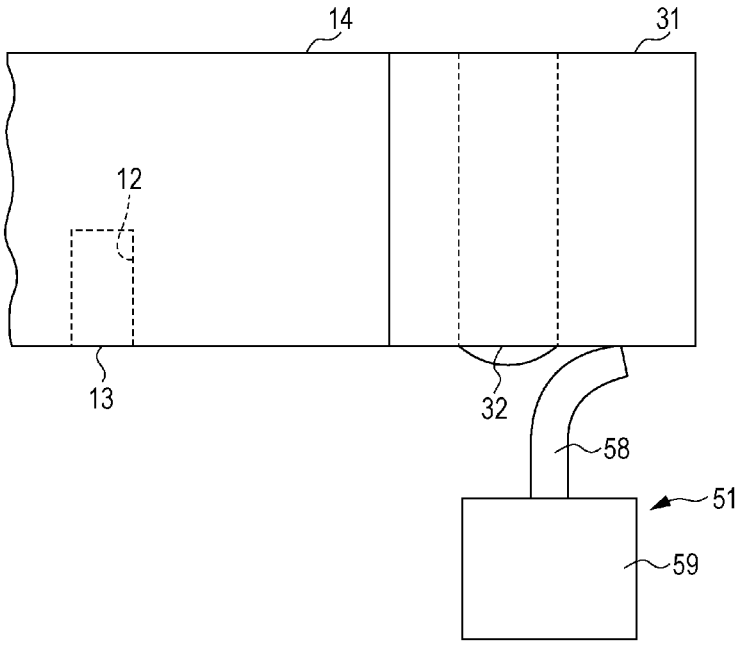
FIG. 3 is a schematic diagram illustrating a situation in which the droplet ejecting apparatus of the first embodiment executes wiping.

In this case, as illustrated in FIG. 3, the wiping may be performed after causing the maintenance liquid to be exuded or be excreted by expansion to a degree in which droplets do not fall from the liquid supply port 32. In order to perform the wiping while wetting the opening surface 17 with the maintenance liquid in this manner, it is preferable that the liquid supply portion 31 have a surface that is integral with the opening surface 17, and that the liquid supply port 32 be opened in the surface.

Next, description will be given of the configuration of the solution supply mechanism 130 which supplies the solution to the droplet ejecting unit 14 with reference to FIGS. 4 and 5. Note that, in FIGS. 4 and 5, depiction of the humidifying mechanism 15 is omitted in order to clarify the configuration of the solution supply mechanism 130.

As illustrated in FIG. 4, the solution supply mechanism 130 is provided with a solution storage portion 210, a solution flow path 220, a flow mechanism 230, and a restriction unit 240. The solution storage portion 210 stores a solution, the solution flow path 220 connects the solution storage portion 210 to the droplet ejecting unit 14, the flow mechanism 230 causes the solution to flow in the solution flow path 220, and the restriction unit 240 is capable of regulating the flow of the solution in the solution flow path 220.

An atmosphere communication valve 160 is provide in the solution storage portion 210. When the atmosphere communication valve 160 assumes the open-valve state, the solution storage portion 210 is communicated with the atmosphere. The solution storage portion 210 communicates with a solution supply source 180 through a filling flow path 170. The filling flow path 170 is provided with a pump 190, and an open-close valve 200. The pump 190 causes the solution to flow from the solution supply source 180 toward the solution storage portion 210, and the open-close valve 200 performs the opening and closing of the filling flow path 170 between the pump 190 and the solution supply source 180. When the pump 190 is driven when the open-close valve 200 is in the open-valve state, the solution flows through the filling flow path 170 to fill the solution storage portion 210 from the solution supply source 180.

The droplet ejecting unit 14 includes a common liquid chamber 410, and a plurality of pressure chambers 420. The common liquid chamber 410 pools the solution supplied from the solution flow path 220, and the plurality of pressure chambers 420 communicate the common liquid chamber 410 with the nozzles 12. In the present embodiment, the solution is supplied to the plurality of nozzles 12 that form a nozzle row through the common liquid chamber 410.

The common liquid chamber 410 and the pressure chambers 420 are partitioned by a diaphragm 440 and communicate with each other through communicating holes 450 that are formed to correspond to the pressure chambers 420. Actuators 470 stored in storage chambers 460 are arranged in positions on the diaphragm 440 which are different from the common liquid chamber 410 on the surface of the opposite side from the portion facing the pressure chambers 420.

Each of the actuators 470 is a piezoelectric element that contracts when a drive voltage is applied thereto, for example. When the drive voltage is applied to the actuator 470, the solution within the pressure chamber 420 is ejected from the nozzle 12 as a droplet due to the diaphragm 440 deforming and the volume of the pressure chamber 420 changing.

The solution flow path 220 includes a solution pooling chamber 270, a supply flow path 280, and a return flow path 290. The solution pooling chamber 270 includes an inlet 250 and outlets 260 and communicates with the common liquid chamber 410, the supply flow path 280 connects the solution storage portion 210 to the inlet 250 and is provided with the flow mechanism 230, and the return flow path 290 connects the outlets 260 to the solution storage portion 210 and is provided with the restriction unit 240. A filter chamber 310 is disposed between the solution pooling chamber 270 and the common liquid chamber 410, and it is preferable to provide the filter chamber 310 with a filter 320.

It is preferable that the solution pooling chamber 270 be provided with a flexible portion 330 capable of changing the volume of the solution pooling chamber 270 by flexible displacement. The flexible portion 330 can be formed by adhering a film member capable of flexible displacement to a flow path forming member that forms a portion of the wall of the solution pooling chamber 270, for example.

It is preferable that the solution pooling chamber 270 include a plurality of (for example, two) outlets 260. In the solution pooling chamber 270, it is preferable that the plurality of outlets 260 be disposed in a position closer to the end portion in the longitudinal direction (the left-right direction in FIG. 4) of the solution pooling chamber 270 than the inlet 250, and that the inlet 250 be disposed between two of the outlets 260 that are lined up in the same longitudinal direction. In the present embodiment, the nozzle row direction is the longitudinal direction of the solution pooling chamber 270.

In the solution pooling chamber 270, the outlets 260 may be disposed closer to the top in the vertical direction than the inlet 250, and the ceiling surface may be inclined such that the ceiling surface of the solution pooling chamber 270 gets higher from the proximity of the center toward both edges in the longitudinal direction. This is because, if this configuration is adopted, the bubbles that enter the solution pooling chamber 270 flow along the inclination of the ceiling surface toward the end portions at which the outlets 260 are present, and easily flow out to the return flow path 290 through the outlets 260. Note that, in FIGS. 4 and 5, a configuration is depicted in which the flexible portion 330 forms the ceiling surface; however, the retention of bubbles is suppressed better when the flexible portion 330 is disposed on a wall surface that does not form the ceiling surface (for example, the side surfaces or the bottom surface), therefore this configuration is preferable.

It is preferable that the connecting portion of the solution pooling chamber 270 in relation to the filter chamber 310 be disposed in a position closer to the outlets 260 than the inlet 250, closer to the bottom in the vertical direction than the inlet 250 and the outlets 260. This is because, if this configuration is adopted, it is possible to suppress the inflow of foreign matter such as bubbles, which enters the solution pooling chamber 270 through the inlet 250, to the filter chamber 310.

It is preferable that a unidirectional valve 340 be provided between the flow mechanism 230 and the inlet 250 in the supply flow path 280. The unidirectional valve 340 is a check valve that allows the flow of the solution from the solution storage portion 210 toward the solution pooling chamber 270 while restricting the flow of solution from the solution pooling chamber 270 toward the solution storage portion 210.

The flow mechanism 230 is a pump which causes the solution to flow from the solution storage portion 210 toward the solution pooling chamber 270 when driven; however, the flow mechanism 230 does not restrict the flow of the solution when not being driven. The flow mechanism 230 can be a gear pump or a diaphragm pump, for example. Note that, when the flow mechanism 230 is a diaphragm pump, the flow mechanism 230 may be provided with a pump chamber, a suction valve, and a delivery valve. The volume of the pump chamber changes with the driving, the suction valve is provided closer to the solution storage portion 210 side than the pump chamber, and the delivery valve is provided closer to the solution pooling chamber 270 than the pump chamber. In this case, the suction valve functions as a unidirectional valve that restricts the flow of the solution from the pump chamber toward the solution storage portion 210 side, and the delivery valve functions as a unidirectional valve that restricts the flow of the solution from the solution pooling chamber 270 side toward the pump chamber; thus, the supply flow path 280 may not be provided with the unidirectional valve 340.

The return flow path 290 includes a main flow path 350 that communicates with the solution storage portion 210, and a plurality of (for example, two) branch flow paths 370 that branch from the main flow path 350 and communicate with the outlets 260. The restriction unit 240 is provided in the main flow path 350. The restriction unit 240 is an open-close valve that changes between an open-valve state and a closed-valve state. In the open-valve state, the flow of the main flow path 350 is permitted, and in the closed-valve state, the flow of the main flow path 350 is restricted. Note that, in the return flow path 290, the flow direction from solution storage portion 210 toward the solution pooling chamber 270 (the direction indicated by the solid-line arrows in FIG. 4) is referred to as the supply direction, and the flow direction from the solution pooling chamber 270 toward the solution storage portion 210 (the direction indicated by the double-dot-dash line arrows in FIG. 4) is referred to as the return direction.

Next, description will be given of the operations of the solution supply mechanism 130.

The solution supply mechanism 130 is set to a circulation mode, a supply mode, or a discharge mode, according to the situation. The circulation mode causes the solution to circulate between the solution storage portion 210 and the solution flow path 220, the supply mode supplies the solution from the solution pooling chamber 270 to the common liquid chamber 410, and the discharge mode causes the solution to be discharged from the nozzles 12. For example, when performing printing on the medium S by ejecting droplets from the nozzles 12, the supply mode is set, and when droplets are not to be ejected from the nozzles 12, that is, when not performing the printing, the circulation mode or the discharge mode is set.

The circulation mode is set when foreign matter such as bubbles that enters the solution flow path 220 and the solution that has increased in viscosity are collected in the solution storage portion 210. The discharge mode is set when discharging the foreign matter collected in the solution storage portion 210 by the circulation mode from the nozzles 12.

In the circulation mode, in a state in which the restriction unit 240 does not restrict the flow of the return flow path 290, the solution stored in the solution storage portion 210 is caused to flow through the supply flow path 280, the solution pooling chamber 270, and the return flow path 290, in order, by the driving of the flow mechanism 230. In other words, in the circulation mode, as indicated by the solid-line arrows in FIG. 4, the solution flows through the supply flow path 280 and enters the solution pooling chamber 270 from the inlet 250. The solution which flows from the solution pooling chamber 270, through the plurality of outlets 260, and out through the branch flow paths 370 of the return flow path 290 flows in the return direction indicated by the double-dot-dash line arrows in FIG. 4, the flows converge in the main flow path 350, and the solution returns to the solution storage portion 210. The foreign matter such as bubbles, which enters the solution flow path 220 by being carried by the flow circulating through the solution storage portion 210, the supply flow path 280, the solution pooling chamber 270, and the return flow path 290, is collected in the solution storage portion 210.

Note that, it is preferable that the supply flow path 280 be connected to the bottom portion of the solution storage portion 210 such that the bubbles collected in the solution storage portion 210 do not flow out to the supply flow path 280. Meanwhile, it is preferable that the return flow path 290 be connected to the solution storage portion 210 closer to the top in the vertical direction than the connecting portion of the supply flow path 280 in relation to the solution storage portion 210. This is because, the bubbles that enter the solution storage portion 210 through the return flow path 290 do not easily enter the supply flow path 280.

However, when the flow mechanism 230 is driven to cause the solution to flow, or the flow is restricted by the restriction unit 240, there is a case in which pressure fluctuation arises in the solution flow path 220 such as the pressure within the solution pooling chamber 270 temporarily rising. When the pressure fluctuations reach the droplet ejecting unit 14, there is a case in which the meniscus formed on the nozzles 12 breaks and the solution leaks from the nozzles 12. Therefore, in the circulation mode, it is preferable to drive the flow mechanism 230 to an extent at which the solution does not leak from the nozzles 12. For example, it is preferable to drive the flow mechanism 230 such that the pressure acting on the meniscus formed on the nozzles 12 due to the flowing of the liquid is lower than the pressure that the meniscus is capable of withstanding.

Note that, if the supply flow path 280 is provided with the unidirectional valve 340, even if air enters instead of the solution leaking from the nozzles 12 due to the meniscus breaking, the air that enters as bubbles does not easily flow backward toward the solution storage portion 210.

If the filter 320 is provided between the solution pooling chamber 270 and the common liquid chamber 410, the increase in flow path resistance due to the filter 320 increases the difficulty of the solution flowing into the common liquid chamber 410 from the solution pooling chamber 270; thus, the pressure fluctuation within the solution pooling chamber 270 does not easily reach the droplet ejecting unit 14.

When the circulation mode is set, it is preferable to dispose the cap portion 53 in a position (a reception position) opposing the nozzles 12 of the droplet ejecting unit 14 or in the capping position at which the droplet ejecting unit 14 is capped. If this configuration is adopted, since it is possible to receive the solution that leaks from the nozzles 12 using the cap portion 53, the periphery is not dirtied by the solution coming from the nozzles 12.

When the droplet ejecting unit 14 is capped in the circulation mode, it is preferable to set the atmosphere-open valve 25 provided in the liquid supply flow path 34 of the humidifying mechanism 15 and the atmosphere-open valve 57 provided in the cap portion 53 to the closed-valve state. This is because, if this configuration is adopted, the leaking of the solution from the nozzles 12 is suppressed due to the closed space Ro to which the nozzles 12 are open is sealed.

In the supply mode, in a state in which the flow mechanism 230 is not driven and the restriction unit 240 does not restrict the flow of the return flow path 290, the solution stored in the solution storage portion 210 is caused to flow to the solution pooling chamber 270 through the supply flow path 280 and the return flow path 290, and the solution is supplied from the solution pooling chamber 270 to the common liquid chamber 410.

During the printing, in which the supply mode is set, when the solution is ejected from the nozzles 12 by driving the actuators 470, the amount of the solution that flows from the pressure chambers 420 due to the ejecting corresponds to the amount of the solution of the solution pooling chamber 270 which is supplied to the pressure chambers 420 through the filter chamber 310 and the common liquid chamber 410. The amount of the solution that flows out to the pressure chambers 420 from the solution pooling chamber 270 corresponds to the amount of the solution of the solution storage portion 210 which is supplied to the solution pooling chamber 270 through the supply flow path 280 and the return flow path 290.

In this manner, when assuming the state in which the restriction unit 240 does not restrict the flow of the return flow path 290, even if the flow mechanism 230 is not driven, in the return flow path 290, the solution flows in the supply direction indicated by the solid-line arrows in FIG. 4, in the supply flow path 280, the solution flows in the direction indicated by the solid-line arrows in FIG. 4, and the solution is supplied to the solution pooling chamber 270. In other words, when ejecting the droplets from the nozzles 12, the solution is supplied from the solution storage portion 210, through the supply flow path 280 and the return flow path 290, to the solution pooling chamber 270.

In the discharge mode, the solution within the solution storage portion 210 is caused to flow through the supply flow path 280, the solution pooling chamber 270, the filter chamber 310, the common liquid chamber 410, and the pressure chamber 420, in order and ejected from the nozzles 12 as illustrated in FIG. 5, by driving the flow mechanism 230 in a state in which the restriction unit 240 restricts the flow of the return flow path 290. Therefore, the foreign matter such as bubbles collected in the solution storage portion 210 is discharged from the nozzles 12 together with the solution.

At this time, since the flow of the solution is restricted by the restriction unit 240 in the return flow path 290, the solution that flows into the solution pooling chamber 270 through the supply flow path 280 flows toward the droplet ejecting unit 14 side without flowing to the return flow path 290. Note that, when solid matter that forms due to the solute component of the ink solidifying is present as the foreign matter that enters the solution, since the flowing of the foreign matter into the common liquid chamber 410 is restricted by the filter 320, the clogging of the nozzles 12 due to solid matter is suppressed. The solution containing foreign matter that is discharged from the nozzles 12 to the cap portion 53 is stored in the waste liquid storage portion 54 as waste liquid by driving the pressure reducing mechanism 56.

When the discharge mode is set, it is preferable to dispose the cap portion 53 in the reception position or the capping position. If this configuration is adopted, since it is possible to receive the solution discharged from the nozzles 12 using the cap portion 53, the periphery is not dirtied by the solution discharged from the nozzles 12.

When the droplet ejecting unit 14 is capped in the discharge mode, if the atmosphere-open valve 25 provided in the liquid supply flow path 34 of the humidifying mechanism 15 and the atmosphere-open valve 57 provided in the cap portion 53 are set to the open-valve state, the solution is discharged smoothly from the nozzles 12 due to the closed space Ro being open to the atmosphere.

Alternatively, when the droplet ejecting unit 14 is capped in the discharge mode, the atmosphere-open valves 25 and 57 may be set to the closed-valve state, the flow mechanism 230 may be driven for a predetermined time, and subsequently, the solution may be discharged from the nozzles 12 by setting the atmosphere-open valve 25 to an open-valve state. In this case, since the closed space Ro is sealed by setting the atmosphere-open valves 25 and 57 to the closed-valve state, the inside of the droplet ejecting unit 14 assumes a pressurized state due to the discharging of the solution from the nozzles 12 being suppressed. In this state, when the atmosphere-open valve 25 is set to the open-valve state, since the solution within the droplet ejecting unit 14 is suddenly discharged into the atmosphere-open closed space Ro, it is possible to promote the discharging of foreign matter.

Note that, it is necessary to set the flow rate of the solution to a fixed value or greater in order to cause the gas to flow with the solution. Therefore, a configuration may be adopted in which, when executing the suction cleaning, the discharge mode is set, and the solution is discharged from the nozzles 12 by driving both the pressure reducing mechanism 56 and the flow mechanism 230. This is because, if this configuration is adopted, since it is possible to increase the flow rate of the solution flowing in the droplet ejecting unit 14 to be faster than in a case in which the solution is caused to flow using only the driving force of the flow mechanism 230, it is possible to efficiently discharge the bubbles. Alternatively, the pressure reducing mechanism 56 may be driven to a degree at which it is possible to collect the solution, which is discharged from the nozzles 12 by the driving force of the flow mechanism 230, in the waste liquid storage portion 54.

The discharging of the solution which is performed by setting the discharge mode can be executed at a predetermined timing at which foreign matter such as bubbles collects in the solution storage portion 210. In a case such as when the solution is consumed by being ejected in the supply mode, and when the solution is discharged from the solution storage portion 210 in the discharge mode, the solution is supplied from the solution supply source 180 to the solution storage portion 210 by driving the pump 190.

According to the first embodiment, it is possible to obtain the following effects.

(1) When the gas supply portion 21 supplies a humidified gas to the closed space Ro, it is possible to quickly raise the humidity in the proximity of the ejecting ports 13 of the capped droplet ejecting unit 14. When the liquid supply portion 31 supplies the liquid for humidifying the closed space Ro in a capped state, it is possible to maintain the humidity in the closed space Ro at a high state for a longer time due to the liquid gradually evaporating in the closed space Ro. Therefore, it is possible to suppress a reduction in the humidity in the proximity of the ejecting ports 13 of the droplets.

(2) When the elapsed time from the cap portion 53 being removed is longer than the threshold, it is possible to increase the amount of the liquid component present within the closed space Ro and to perform the humidification at a higher humidity by performing the next capping in a state in which the closed space Ro contains the liquid supplied from the liquid supply portion 31.

(3) When the elapsed time from the cap portion 53 being removed is equal to or less than the threshold, it is possible to reduce the amount of the liquid that is consumed for the humidification by performing the next capping in a state in which the closed space Ro contains the gas supplied by the gas supply portion 21.

(4) Since the liquid pooling portion 33 communicates with the gas pooling portion 23, it is possible to humidify the gas pooled in the gas pooling portion 23 using the liquid pooled in the liquid pooling portion 33. Therefore, since it is not necessary to provide a mechanism for generating humidified air separately from the fluid pooling portion 19 provided with the liquid pooling portion 33, it is possible to simplify the configuration of the apparatus. Since the liquid supply portion 31 supplies the liquid pooled in the liquid pooling portion 33 to the cap portion 53, it is possible to maintain the humidity in the proximity of the ejecting ports 13 in the capped state while suppressing the adhesion of droplets to the droplet ejecting unit 14. Since the gas supply portion 21 supplies the gas pooled in the gas pooling portion 23 to the closed space Ro, it is possible to suppress the leaking of the humidified gas and efficiently maintain the humidity of the closed space Ro.

(5) Since the gas supply port 22 and the liquid supply port 32 are open toward to outside of the region in which the medium S is disposed, even when the liquid leaks from the gas supply port 22 or the liquid supply port 32, it is possible to suppress the adhesion of the leaked liquid to the medium S.

(6) When the power source is turned off in a state in which the inside of the closed space Ro is humidified, there is a case in which, when the temperature drops, condensation forms on the opening surface 17. When the liquid that condenses in this manner comes into contact with the droplets ejected toward the medium S from the ejecting ports 13, there is a concern that the flight direction of the ejected droplets will be shifted. To address this point, according to the embodiment described above, after turning on the power source, since the wiper 58 wipes the opening surface 17 before the droplet ejecting unit 14 ejects the droplets onto the medium S, it is possible to remove the condensed liquid.

Second Embodiment

Next, description will be given of the second embodiment of the droplet ejecting apparatus with reference to FIG. 6.

Note that, in the second embodiment, description of components with the same reference numerals as those in the first embodiment will be omitted as being provided with the same configuration as those in the first embodiment, and hereinafter, description will be given centered on the points which differ from the first embodiment.

Figure 6:
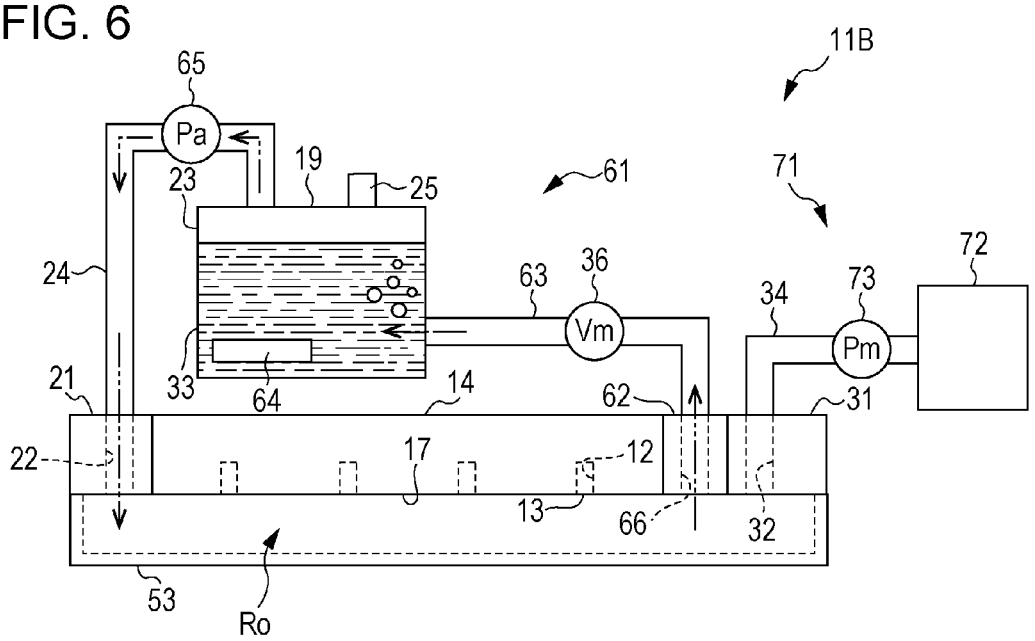
FIG. 6 is a schematic diagram illustrating a configuration of a droplet ejecting apparatus of a second embodiment.

As illustrated in FIG. 6, a droplet ejecting apparatus 11B of the present embodiment is provided with the droplet ejecting unit 14, a gas supply mechanism 61, a liquid supply mechanism 71, and the cap portion 53. The gas supply mechanism 61 is for supplying humidified gas to the closed space Ro, the liquid supply mechanism 71 is for supplying maintenance liquid, and the cap portion 53 is capable of moving relative to the droplet ejecting unit 14. The droplet ejecting apparatus 11B is provided with the same solution supply mechanism 130 (omitted from FIG. 6, refer to FIGS. 4 and 5) as that of the first embodiment.

The gas supply mechanism 61 is provided with the gas supply portion 21, a gas collection portion 62, the fluid pooling portion 19, the gas supply flow path 24, and the return flow path 63. The gas supply portion 21 and the gas collection portion 62 are disposed to be lined up with the droplet ejecting unit 14, the fluid pooling portion 19 includes the liquid pooling portion 33 and the gas pooling portion 23, the gas supply flow path 24 connects the gas pooling portion 23 to the gas supply portion 21, and the return flow path 63 connects the liquid pooling portion 33 to the gas collection portion 62. The gas collection portion 62 is provided with a ventilation port 66 through which a gas can flow. The return flow path 63 is provided with the open-close valve 36.

A liquid (for example, a liquid containing a solvent component of a solution such as water) for humidifying the gas is pooled in the liquid pooling portion 33 provided on the lower portion of the fluid pooling portion 19. The liquid pooling portion 33 may be provided with a heater 64 for promoting the evaporation of the liquid pooled in the liquid pooling portion 33. Air containing the liquid component that evaporates from the liquid pooling portion 33 is pooled as the humidified gas in the gas pooling portion 23 provided on the upper portion of the fluid pooling portion 19.

The atmosphere-open valve 25 is provided in the gas pooling portion 23. The gas supply flow path 24 is provided with a gas supply pump 65 for supplying the humidified gas pooled in the gas pooling portion 23.

The liquid supply mechanism 71 is provided with the liquid supply portion 31, a liquid pooling portion 72, and a liquid supply pump 73. The liquid supply portion 31 is disposed to line up with the gas collection portion 62, the liquid pooling portion 72 is connected to the liquid supply portion 31 via the liquid supply flow path 34, and the liquid supply pump 73 is provided in the liquid supply flow path 34. The maintenance liquid is pooled in the liquid pooling portion 72. Note that, the liquid supply portion 31 may be disposed to line up with the droplet ejecting unit 14 or the gas supply portion 21.

In the present embodiment, the cap portion 53 may be provided as the maintenance mechanism, and the wiping mechanism 51, the waste liquid storage portion 54, the waste liquid flow path 55, the pressure reducing mechanism 56, and the atmosphere-open valve 57 may not be provided. Note that, in the capped state, by setting the atmosphere-open valve 25 to the open-valve state, it is possible to open the closed space Ro to the atmosphere.

The cap portion 53 moves in a direction approaching the droplet ejecting unit 14 and performs capping in which the space to which at least the ejecting ports 13, the gas supply port 22, and the ventilation port 66 are open is set to the closed space Ro. Note that, in the capped state, if the cap portion 53 is formed to surround the closed space Ro, which includes the liquid supply port 32 in addition to the ejecting ports 13, the gas supply port 22, and the ventilation port 66, it is possible to supply the maintenance liquid from the liquid supply port 32 to the cap portion 53 in the capped state, therefore, this configuration is preferable.

Note that, it is possible to adopt a configuration in which the capping is performed by the droplet ejecting unit 14 moving in the direction approaching the cap portion 53. It is preferable that the gas supply port 22, the ventilation port 66, and the liquid supply port 32 be open toward the outside of the printing region PA (refer to FIG. 1).

Next, description will be given of the operations and actions of the droplet ejecting apparatus 11B.

In the present embodiment, when the maintenance liquid is supplied to the cap portion 53, by driving the liquid supply pump 73, the maintenance liquid pooled in the liquid pooling portion 72 is supplied through the liquid supply flow path 34 and the liquid supply portion 31, and is discharged from the liquid supply port 32 to the cap portion 53.

When the humidified air is supplied to the closed space Ro in the present embodiment, after performing the capping, in addition to setting the atmosphere-open valve 25 to the closed-valve state, the open-close valve 36 is set to the open-valve state and the gas supply pump 65 is driven. Thus, the humidified gas within the gas pooling portion 23 flows into the closed space Ro through the gas supply flow path 24 and the gas supply portion 21, the gas within the closed space Ro flows into the ventilation port 66, passes the gas collection portion 62 and the return flow path 63, and is collected in the fluid pooling portion 19. In other words, the gas circulates between the fluid pooling portion 19 and the closed space Ro.

Note that, when the humidified air is supplied to the closed space Ro, by heating the liquid pooled in the liquid pooling portion 33 using the heater 64, it is possible to quickly humidify the gas pooled in the gas pooling portion 23.

However, when setting the solution supply mechanism 130 to the circulation mode in a state in which the droplet ejecting unit 14 is capped, it is best to avoid performing the heating of the liquid using the heater 64. This is because, when the gas that is humidified by the heating of the heater 64 flows into the closed space Ro, the ejecting ports 13 are humidified, the meniscus becomes easier to break, and there is a concern that this will cause the solution to leak from the nozzles 12.

According to the second embodiment described above, it is possible to obtain the same operations and effects as (1) to (3), and (5).

Note that, the embodiments described above may be modified as described below.

The liquid pooling portion 33 capable of pooling the liquid and the gas pooling portion 23 capable of pooling the gas may be configured separately from each other, and both the pooling portions may be connected by a connecting flow path through which the gas is capable of flowing. Even in this case, it is possible to humidify the gas within the liquid pooling portion 33 using the liquid within the liquid pooling portion 33.

When the elapsed time from the cap portion 53 being removed is longer than the predetermined threshold, the next capping may be performed in a state in which the closed space Ro contains the maintenance liquid and the humidified gas. Note that, in this case, when the elapsed time from the cap portion 53 being removed is less than or equal to the threshold, the next capping may be performed in a state in which the closed space Ro contains one of the maintenance liquid or the humidified gas.

When two different thresholds M1 and M2 (M1<M2) are set and the elapsed time from the cap portion 53 being removed is set to T, when M1<T<M2, the next capping may be performed in a state in which the closed space Ro contains the maintenance liquid, and when M2≤T, the next capping may be performed in a state in which the closed space Ro contains the maintenance liquid and the humidified gas. In this case, when T<M1, it is preferable to perform the next capping in a state in which the closed space Ro contains the humidified gas. If this configuration is adopted, when M2≤T, it is possible to quickly humidify the dried nozzles 12 using the humidified gas, and to suppress a reduction in the humidity using the maintenance liquid.

a humidity detection unit which detects humidity may be provided. When a humidity detected by the humidity detection unit is lower than a predetermined threshold, capping may be performed in a state in which the closed space Ro contains the maintenance liquid. Meanwhile, when the humidity is greater than or equal to the threshold, the capping may be performed in a state in which the closed space Ro contains humidified air. According to this configuration, it is possible to suppress a decrease in the humidity in the proximity of the ejecting ports even in a situation in which the humidity of the periphery is low and the proximity of the ejecting ports 13 easily becomes dried.

The pooled amount of the maintenance liquid in the fluid pooling portion 19 may be detected by the detection unit 45 in the capped state. When the pooled amount of the maintenance liquid is greater than a predetermined threshold, the maintenance liquid may be supplied to the cap portion 53. Meanwhile, when the pooled amount of the maintenance liquid is less than or equal to the threshold, the humidified air may be supplied to the closed space Ro. According to this configuration, when the pooled amount of the maintenance liquid is reduced, it is possible to perform the humidification of the proximity of the ejecting ports 13 while suppressing the amount of the maintenance liquid that is consumed.

The capping may be performed in a state in which, when the power source is turned off, the maintenance liquid is supplied to the cap portion 53, and the closed space Ro contains the maintenance liquid. According to this configuration, even in a case in which the capped state continues for a long time, such as when the power source is off, it is possible to maintain the humidity inside the closed space Ro at a high state. Therefore, it is possible to suppress a reduction in the humidity in the proximity of the ejecting ports 13 of the droplets.

A configuration may be adopted in which whether the humidification of the closed space Ro is performed using the maintenance liquid, whether the humidification is performed by using the humidified air, or whether the capping is performed without performing the humidification can be changed according to the setting carried out by a user. According to this configuration, it is possible to perform the humidification of the closed space Ro appropriately according to the situation in which the droplet ejecting apparatus 11 is used. For example, when the droplet ejecting apparatus 11 is not used for a while, the capping can be performed in a state in which the closed space Ro contains the maintenance liquid.

A configuration may be adopted in which it is possible to change the amount of the maintenance liquid or the amount of the humidified air contained in the closed space Ro in the capped state, for example, according to the setting or the like carried out by the user. According to this configuration, it is possible to perform the humidification of the closed space Ro appropriately according to the situation in which the droplet ejecting apparatus 11 is used. Meanwhile, it is possible to greatly suppress the consumption amount of the maintenance liquid or the liquid for humidifying the gas.

The droplet ejecting apparatus may be a printer provided with only a printing function, and may be a facsimile, a photocopier, or a printer that is provided in a multi-function device provided with these apparatuses.

The liquid ejected by the droplet ejecting unit may be a fluid other than ink (including a liquid, a liquid body in which particles of a functional material are dispersed or mixed in a liquid, a fluid body such as a gel, and a solid that can be caused to flow as a fluid and ejected). For example, a configuration may be adopted in which the liquid ejecting apparatus ejects a liquid body which contains a material such as an electrode material or a color material (pixel material) in the form of a dispersion or a solution. The electrode material or the color material may be used in the manufacture or the like of liquid crystal displays, Electro-Luminescence (EL) displays, and surface emission displays.

The entire disclosure of Japanese Patent Application No. 2014-000786, filed Jan. 7, 2014 and No. 2014-003968, filed Jan. 14, 2014 are expressly incorporated by reference herein.

What is claimed is:

1. A droplet ejecting apparatus comprising:

a droplet ejecting unit provided with ejecting ports capable of ejecting a solution onto a medium as droplets;

a cap portion which performs capping in which a region to which the ejecting ports are open is set to a closed space;

a gas supply portion capable of supplying a humidified gas to the closed space; and a liquid supply portion capable of supplying a liquid for humidifying the closed space.

2. The droplet ejecting apparatus according to claim 1, wherein, when an elapsed time from the cap portion being removed is longer than a threshold, a next capping is performed in a state in which the closed space contains the liquid supplied by the liquid supply portion.

3. The droplet ejecting apparatus according to claim 1, wherein, when an elapsed time from the cap portion being removed is less than or equal to a threshold, a next capping is performed in a state in which the closed space contains a humidified gas supplied by the gas supply portion.

4. The droplet ejecting apparatus according to claim 1, further comprising:

a fluid pooling portion provided such that a liquid pooling portion capable of pooling a liquid and a gas pooling portion capable of pooling a gas communicate with each other, wherein the liquid supply portion supplies a liquid pooled in the liquid pooling portion to the cap portion, and the gas supply portion supplies a gas pooled in the gas pooling portion to the closed space.

5. The droplet ejecting apparatus according to claim 1, wherein the gas supply portion is provided with a gas supply port out of which a gas is capable of flowing, wherein the liquid supply portion is provided with a liquid supply port out of which a liquid is capable of flowing, and wherein the gas supply port and the liquid supply port are open toward an outside of a region in which the medium is disposed.

6. The droplet ejecting apparatus according to claim 1, further comprising:

a wiper capable of wiping an opening surface in which the ejecting ports of the droplet ejecting unit are opened, wherein, when performing capping when a power source is turned off, after turning on the power source, the wiper wipes the opening surface before the droplet ejecting unit ejects droplets onto the medium.

7. The droplet ejecting apparatus according to claim 1, wherein the liquid supply portion is provided with a liquid supply port which is open toward an outside of a region in which the medium is disposed and out of which a liquid is capable of flowing, and wherein the wiper wipes an opening surface in a state in which the liquid that flows out from the liquid supply port is adhered to the opening surface.

8. The droplet ejecting apparatus according to claim 1, wherein, when an elapsed time from the cap portion being removed is longer than a threshold, a next capping is performed in a state in which the closed space contains a liquid supplied by the liquid supply portion, and, when the elapsed time is less than or equal to the threshold, the next capping is performed in a state in which the closed space contains a humidified gas supplied by the gas supply portion.

9. The droplet ejecting apparatus according to claim 1, wherein, when an elapsed time from the cap portion being removed is longer than a first threshold and shorter than a second threshold that is greater than the first threshold, a next capping is performed in a state in which the closed space contains a liquid supplied by the liquid supply portion, when the elapsed time is less than or equal to the first threshold, the next capping is performed in a state in which the closed space contains a humidified gas supplied by the gas supply portion, and, when the elapsed time is greater than or equal to the second threshold, the next capping is performed in a state in which the closed space contains the liquid supplied by the liquid supply portion and the humidified gas supplied by the gas supply portion.

10. The droplet ejecting apparatus according to claim 1, further comprising:

a humidity detection unit which detects humidity, wherein, when a humidity detected by the humidity detection unit is lower than a predetermined threshold, a next capping is performed in a state in which the closed space contains a liquid supplied by the liquid supply portion, and, when the humidity is greater than or equal to the threshold, the next capping is performed in a state in which the closed space contains a humidified gas supplied by the gas supply portion.

* * * * *